US009758983B2

(12) United States Patent
Simmons et al.

(10) Patent No.: US 9,758,983 B2
(45) Date of Patent: Sep. 12, 2017

(54) DUAL-FUNCTION, SEQUENTIAL-TASK, LUG-REGISTRY, PICK AND STACK-ALIGN BUILDING-COMPONENT HANDLING SYSTEM

(71) Applicant: ConXtech, Inc., Pleasanton, CA (US)

(72) Inventors: Robert J. Simmons, Hayward, CA (US); Maxwell C. Simmons, Hayward, CA (US)

(73) Assignee: ConXtech, Inc., Pleasanton, CA (US)

( * ) Notice: Subject to any disclaimer, the term of this patent is extended or adjusted under 35 U.S.C. 154(b) by 0 days.

(21) Appl. No.: 15/226,858

(22) Filed: Aug. 2, 2016

(65) Prior Publication Data

US 2017/0051524 A1 Feb. 23, 2017

Related U.S. Application Data

(63) Continuation of application No. 14/712,605, filed on May 14, 2015, now Pat. No. 9,404,280, which is a (Continued)

(51) Int. Cl.
*E04H 12/22* (2006.01)
*E04G 21/14* (2006.01)

(Continued)

(52) U.S. Cl.
CPC ..... *E04H 12/2238* (2013.01); *B66C 1/62* (2013.01); *B66C 1/666* (2013.01); *E02D 27/42* (2013.01);

(Continued)

(58) Field of Classification Search
CPC ..... E04H 12/2238; E04H 12/2276; E04H 12/2284; E04H 12/22; E04H 12/2253; E02D 27/42

(Continued)

(56) References Cited

U.S. PATENT DOCUMENTS 3,429,092 A * 2/1969 Hart ..... E04B 1/20 52/236.7
6,082,070 A * 7/2000 Jen ..... E04B 1/24 403/170

(Continued)

FOREIGN PATENT DOCUMENTS

DE 4106743 A1 * 9/1992 ..... E04H 12/2253
GB WO 2011018596 A1 * 2/2011 ..... E04H 12/2215
JP 06185070 A * 7/1994

*Primary Examiner* — Adriana Figueroa
(74) *Attorney, Agent, or Firm* — Kolisch Hartwell, P.C.

(57) ABSTRACT

A system for handling various structural building components including a pick and stack-registry lug which is anchorable to the top of a building component for handling that component in either one, or both sequentially, of its two, pick and stack-registry functional modes, (b) a clamshell-style, releasably lockable clasp adapted to receive and close capturingly upon the lug under operational circumstances with the lug anchored to the top of a building component, and ready to function in its pick category of component-handling behavior, and (c) a guide socket includable in the base of a building component functional for camming, guided reception of a lug with the lug then functioning in its stack-registry mode of behavior to facilitate overhead stack registering of two building components in relation to the lowering of an overhead component onto the top of an underlying component whose top also has a lug anchored to it.

17 Claims, 5 Drawing Sheets

Figure 3:
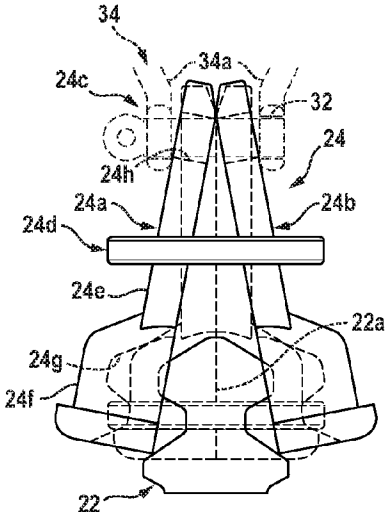

Related U.S. Application Data continuation of application No. 14/163,778, filed on Jan. 24, 2014, now Pat. No. 9,103,132.

(60) Provisional application No. 61/757,201, filed on Jan. 27, 2013.

(51) Int. Cl.

| | |
|---|---|
| ***E04C 3/30*** | (2006.01) |
| ***B66C 1/66*** | (2006.01) |
| ***B66C 1/62*** | (2006.01) |
| ***E02D 27/42*** | (2006.01) |
| *E04C 3/34* | (2006.01) |

(52) U.S. Cl.

CPC ..... *E04C 3/30* (2013.01); *E04G 21/142* (2013.01); *E04H 12/22* (2013.01); *E04H 12/2253* (2013.01); *E04H 12/2276* (2013.01); *E04H 12/2284* (2013.01); *E04C 3/34* (2013.01)

(58) Field of Classification Search

USPC ..... 52/126.1–126.7

See application file for complete search history.

(56) References Cited

U.S. PATENT DOCUMENTS

| | | | | |
|---|---|---|---|---|
| 6,618,953 | B2 * | 9/2003 | Izumi | E04H 12/2284 248/514 |
| 6,625,937 | B1 * | 9/2003 | Parker | E04B 1/3483 52/79.1 |
| 6,796,089 | B1 * | 9/2004 | Campbell | E02D 27/02 52/126.5 |
| 7,850,148 | B2 * | 12/2010 | Collins, IV | E04H 12/2261 248/156 |
| 8,375,650 | B2 * | 2/2013 | Gratzer | E04H 12/10 52/127.1 |
| 8,453,416 | B2 * | 6/2013 | Brindle | E04C 3/005 52/126.7 |
| 8,584,404 | B2 * | 11/2013 | Heidenreich | E04B 1/24 52/126.6 |
| 2005/0252124 | A1 * | 11/2005 | Bergman | E04H 12/2253 52/296 |

* cited by examiner

DUAL-FUNCTION, SEQUENTIAL-TASK, LUG-REGISTRY, PICK AND STACK-ALIGN BUILDING-COMPONENT HANDLING SYSTEM

CROSS-REFERENCE TO RELATED APPLICATION

This application is a continuation of U.S. patent application Ser. No. 14/712,605, filed May 14, 2015, which is a continuation of U.S. patent application Ser. No. 14/163,778, filed Jan. 24, 2014 which claims priority from U.S. Provisional Patent Application Ser. No. 61/757,201, filed Jan. 27, 2013, for "Quick Connect/Release, Clasp and Bulb, Pick, Gravity-Align-and-Place, Industrial-Module Handling Structure". The complete disclosures of each application are hereby incorporated by reference in their entireties for all purposes.

BACKGROUND AND SUMMARY OF THE INVENTION

This invention pertains to a system for handling and manipulating structural building-frame components, also referred to herein more simply both as building components, and as components, during the construction of a building frame, and in particular to such a system which promotes simple, efficient, precision-handling and precision-alignment construction performance through providing uniquely configured, and cooperatively interactive, lug, clasp, and guide-socket system elements that enable special, dual-mode, and selectively, task-sequential, invention practices involving structural-building-component (a) picking, (b) transporting, (c) positional placing, and (d) component-above-component, aligned stacking for the stack-registry joining of two vertically organized components, and additionally, (e) vertical-registration installing of component-preassembled building-frame modules, also referred to as building modules.

Each of the terms "building-frame component", "building component", and "component", as used herein, refers inclusively, but not exclusively, to columns, to ground-support, pedestal-like structures that support the bases of columns, and to unitized, building-frame pre-assemblies of columns and beams that are to be incorporated in an under-construction building frame. The terms "module", "building-frame module", "building module", and the like, are used herein interchangeably to refer to unitized, building-frame pre-assemblies of columns and beams.

A preferred embodiment of, and manner of practicing, the invention are illustrated and described herein in relation to the fabrication of a steel-component building-frame assembly which is, essentially, being readied for ultimate, on-site, ground installation, formed with preliminarily-employed, column-base ground supports, with columns supported on such supports and on other columns, and with preassembled, underlying-frame-installable building modules. Illustrative handled components discussed and pictured herein include the mentioned preliminarily-used, column-base ground supports (also referred to herein as ground supports for columns), individual columns, and preassembled building-module assemblies. The elements and features of the invention are described particularly in relation to the handling of these three categories of structural building components with respect to which the invention has been found to offer particular utility. We recognize, of course, that other specific kinds of building components, such as beams, outrigger worker scaffolding, and things, may also be handled by the system of the invention.

In the system of the present invention, the key inter-cooperative system elements include (1) a specially shaped, body-of-revolution lug which is referred to as being a dual-mode, sequential-task, pick and stack-registry lug, (2) a clamshell-like releasably lockable clasp which is engageable with this lug with the lug operating in its pick mode of behavior, and (3) guide-socket structure, or a guide socket, which is includable, or formed (as will be explained in the setting of a column) in the base of a component to be handled—typically a column—to enable guided, stack-registry lowering of such a component, poised as an overhead component, onto the top of an underlying component for mounting thereon, and specifically a lowering which involves guided, and if needed cammed (i.e., guided sliding contact), reception in the socket structure of a lug made in accordance with the invention anchorably attached appropriately to the top of the underlying component, and functioning in its pick-registry mode of behavior.

Accordingly, from one point of view, the invention features a building-component handling system including:

(1) a unique, dual-mode, sequential-task, pick and stack-registry lug, having a body of revolution with a specially shaped, combined-utility, (a) grasp-and-capture, and (b) registry-camming, profile, anchorably attachable to the top of a selected, structural building component for performance with that component in either one, or both sequentially, of its two, designed-for, operational task modes—picking and stack registering;

(2) a generally clamshell-style, releasably lockable clasp having openable and closeable, somewhat ladle-shaped clasp portions adapted to receive, in a clasp-open condition, and to close, in a clasp-closed condition, collaboratively and capturingly upon the lug profile under operational circumstances with the lug anchorably attached to a selected structural building component, and then functioning in what is referred to as the "pick", "picking", or "pick handling" category of its dual-mode capability; and (3) a guide socket structure included in the base of an "overhead" structural building component, shaped for camming reception of the registry-camming, profile of the lug, with the lug then functioning in what is referred to as the "stack-registry", or "stack-registering", category of its dual-mode capability, to accommodate overhead stacking registry of two structural building components, and specifically respecting the lowering, for mounting, of an overhead component onto the top of an underlying component.

This point of view especially, though not exclusively, focuses on individual component pick and stack-registry handling, where the term "pick" is employed herein to "cover" several, associated activities, including lug grasping and picking up of a selected building component, and then transporting, maneuvering and positionally placing that component where it is intended to go. Stack registry refers to precision vertical alignment of a picked, overhead component, and a second, underlying component, through camming engagement between a lug anchored to the top of the underlying component and a guide socket furnished in the base of the overhead component, to promote precision placement of the overhead component on top of the underlying one as a component-on-component mounting precursor. The phrase dual-mode as applied to the system lug reflects the facts that this lug is designed to operate in both (1) a pick mode and (2) a stack-registry mode. The concept referred to as sequential-task, or variously as task-sequential, relating to the system lug, is associated with the situation that a lug first employed in its pick mode with respect to a handled building component and the clasp of the invention, is thereafter, i.e., in a sequential manner, employed in its stack-registry mode in cooperation with a system guide-socket structure furnished in the base of an overhead component to align the two components for stacked, vertical assembly.

In relation to the handling, for installation in a frame structure, such as an under-construction, ground-supported portion of a structural building frame, of a preassembled building module including interconnected columns and beams, the invention proposes a combined building-frame construction project, and an associated, structural-component handling system which is functionally involved in the project, which, in operative conditions with respect to one another, and relative to a particular fabrication stage in the project, include (1) a ground-supported structural building frame assembly having a portion possessing a defined pattern of elongate, upright columns with tops and central, upright axes, readied to have lowered to and stack-mounted on it a preassembled, overhead frame module, (2) a dual-function, pick and stack-registry lug having a central axis anchored to the top of each column in the ground-supported frame portion with the lug's central axis aligned with the central axis in the column to whose top it is anchored, poised to function for promoting stack registry in the project with respect to a lowered-for-mounting preassembled, overhead frame module, (3) a preassembled frame module intended for overhead mounting on the ground-supported frame portion possessing a pattern of elongate, upright columns exactly matching the column pattern present in the ground-supported frame potion, with the columns in the frame module having bases and tops, and respective, central, upright axes, and with the frame module, in relation to the mentioned, particular fabrication stage in the project, poised overhead the ground-supported frame portion, (4) a pick and stack-registry, lug-reception socket furnished in the base of each column in the frame module, and having a body of revolution with a central axis centered on the long axis of that column, and adapted guidingly to receive a pick and stack-registry lug anchored to the top of an underlying column in the ground-supported frame portion on appropriate lowering of the frame module toward the ground-supported frame portion, (5) an elongate, pick and stack-registry lug of the type described above anchored to the top of each column in the frame module, employed to function for picking in the project with respect to accommodating holding and maneuvering of the frame module, (6) associated with each lug which is anchored to the top of a column in the frame module, a clamshell-style clasp positively, securely, and releasably clasping the lug for cooperative pick handling of both the associated column and the overall frame module containing the column, and (7) maneuverable cable suspension structure, appropriately and operatively connected to each clasp, operable to maneuver the frame module to a position overhead the ground-supported frame portion wherein the columns in the frame module are all precisely aligned with the columns in the ground-supported frame portion, and with such alignment achieved, to lower the frame module to a condition of gravity-seated stack registry relative to the ground-supported frame portion through stack-registry engagement between the lugs associated with the latter and the lug-reception sockets associated with the former.

The term "upright" as used herein in references made to the "central axes" of various building structures and system elements is meant to refer to the conditions of these axes under circumstances where the associated structures and elements are in their intended spatial orientations.

These and other features and advantages offered by the present invention will become more fully apparent as the detailed description of it which now follows is read in conjunction with the accompanying drawings.

DESCRIPTIONS OF THE DRAWINGS

Figure 1D:
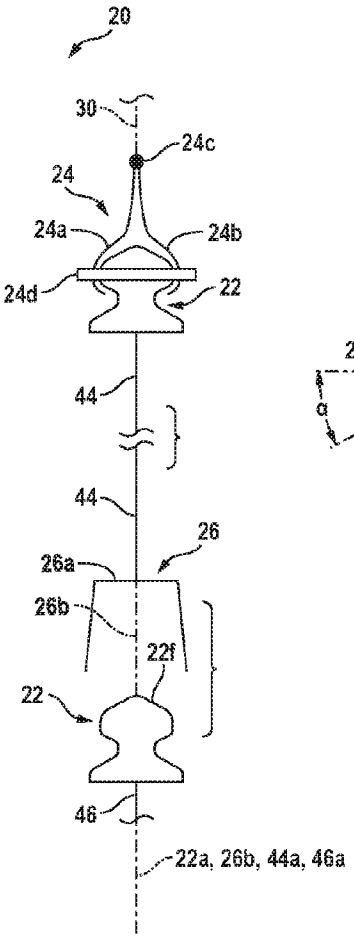
Figure 1A:
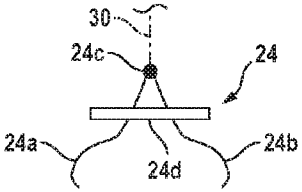
Figure 1B:
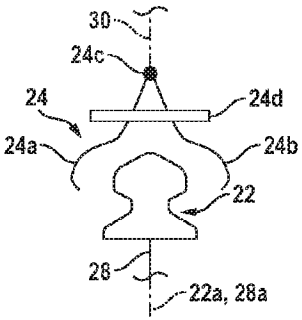
Figure 1C:
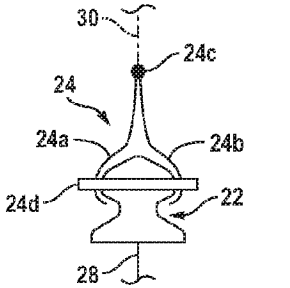

FIGS. 1A, 1B, 1C and 1D collectively provide simplified, schematic, collaboratively plural-view diagrams illustrating the three, principal structural elements of the system of the present invention mentioned above, along with two, illustrative—(1) pick, and (2) stack-registry—operations performed by those elements. FIGS. 1A, 1B and 1C picture reversible pick grasping activity between a dual-mode, sequential-task, pick and stack-registry registry lug constructed in accordance with the invention and a cooperatively related, clamshell-style releasable locking clasp. FIG. 1D illustrates substantially completed pick of an overhead building component, and subsequent stack-registry lowering of that overhead component onto the top of an underlying building component—these two, overall activities featuring cooperative actions of a pair of same-construction pick and stack-registry lugs, a clamshell-style clasp, and a guide socket structure constructed in accordance with the invention.

The four system views presented in FIGS. 1A, 1B, 1C and 1D, are referred to herein variously as the "FIG. 1" views, as the collection of "FIG. 1" views, and with other, similar, plural-views identities.

Figure 2:
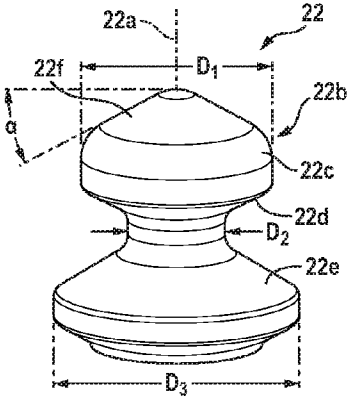

FIG. 2 illustrates isometrically, on a much larger scale than that which is employed in FIGS. 1A, 1B, 1C and 1D, and isolated from any other structure, preferred configurational features of the dual-mode, sequential-task, pick and stack-registry lug seen schematically in the collection of "FIG. 1" views.

FIG. 3, which employs a slightly smaller drawing scale than that chosen for FIG. 2, illustrates non-schematically, in a representative, operational relationship to an also shown system lug, like the lug pictured in FIG. 2, a clamshell-style, releasably lockable clasp, presented in solid lines with its included, hinged and relatively moveable ladle-shaped clasp portions displayed in a clasp-open condition, and in dashed lines in a clasp-closed condition. This clasp is demonstrated here as being used for pick handling of the lug illustrated in the figure.

Figure 4:
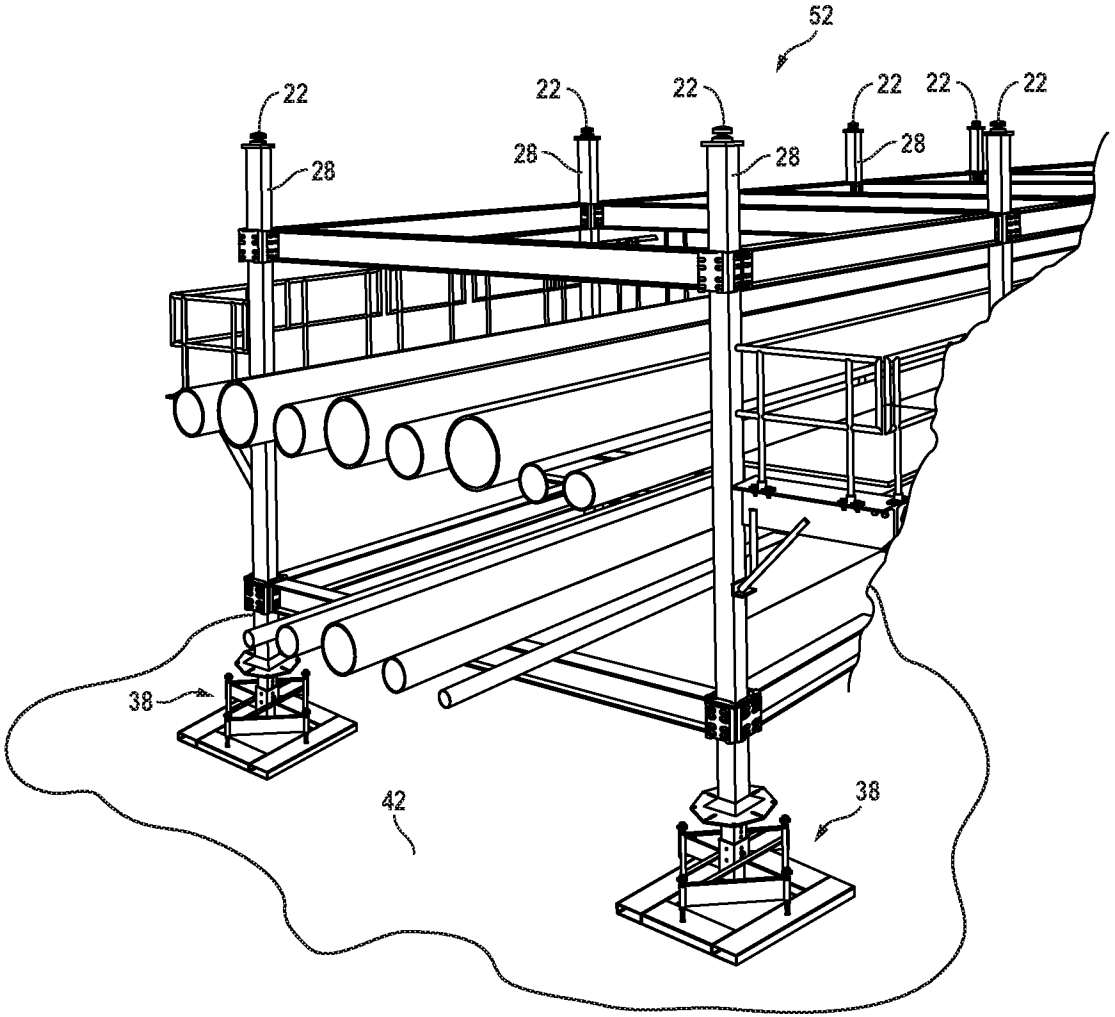

FIG. 4, drawn on a significantly smaller scale than those employed in FIGS. 2 and 3, illustrates, isometrically, a fragmentary portion of an open, column-and-beam, pipe-support frame structure specifically picturing both columns, and ground-support structures for the bases of these columns, which have been equipped for handling, and which have been handled, during the construction of the illustrated frame, in accordance with the system structures and the system practice of the present invention.

Figure 5:
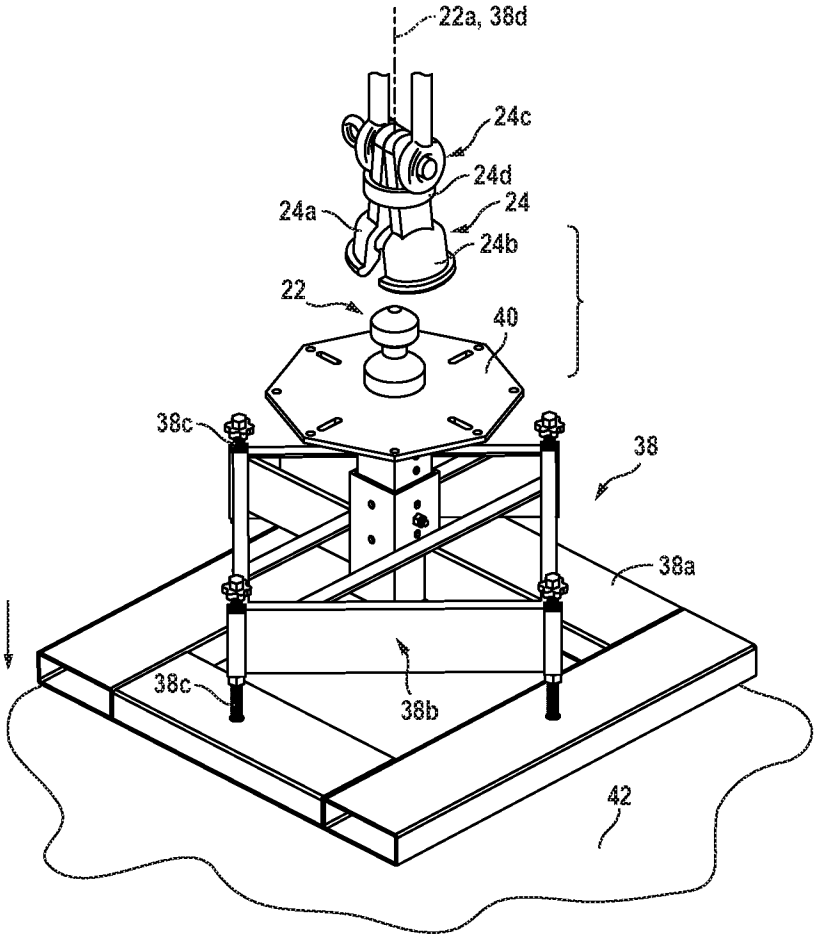

FIG. 5, on a drawing scale that is somewhat larger than the one employed in FIG. 4, pictures, isometrically, a column-base ground support having anchorably attached to its top a lug, like the lug shown in FIG. 2, which lug is about to be grasped releasably by a releasably lockable clasp constructed in accordance with the present invention, for pick handling and maneuvering the ground support to place it at a selected location on the ground, as indicated by the downwardly pointing arrow which is included in FIG. 5.

Figure 6:
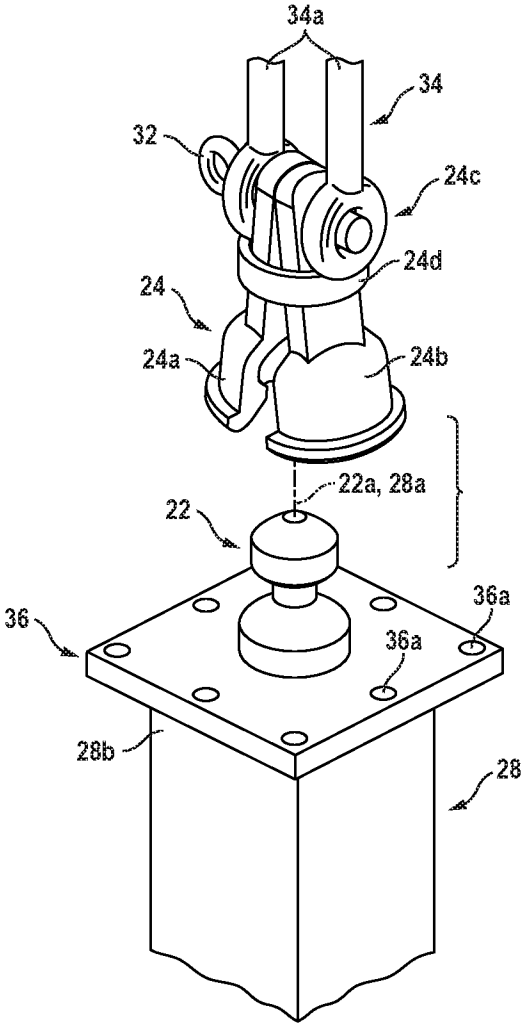

FIG. 6, which has certain operational similarities to FIG. 5, illustrates, isometrically, pick handling for maneuvering of a column.

Figure 7:
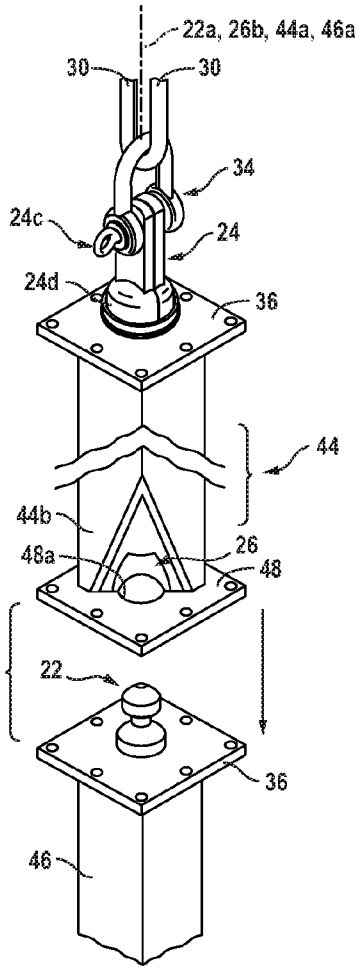

FIG. 7 illustrates, isometrically, clasp and lug pick handling of one column, and prospective stack-registry alignment and placement, of that one (overhead) column on top of another (underlying) column, employing the lug, clasp and guide-socket system elements of the present invention. Here, a breakaway region in the base of the one, overhead column shows guide-socket structure furnished in the base of the overhead column in relation to impending, interactive camming reception of the visible lug (on the top of the lower column) within the inside of the exposed guide socket.

Figure 8:
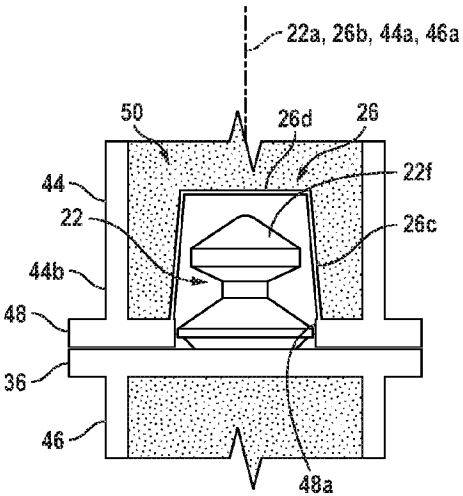

FIG. 8 is an enlarged, fragmentary, cross-sectional image, related to FIG. 7, showing the end result of stack-registry, lug-and-socket camming-alignment behavior created from the lug and guide socket interaction seen to be impending in the column-to-column, stack-registry-alignment process which is illustrated in FIG. 7.

Figure 9:
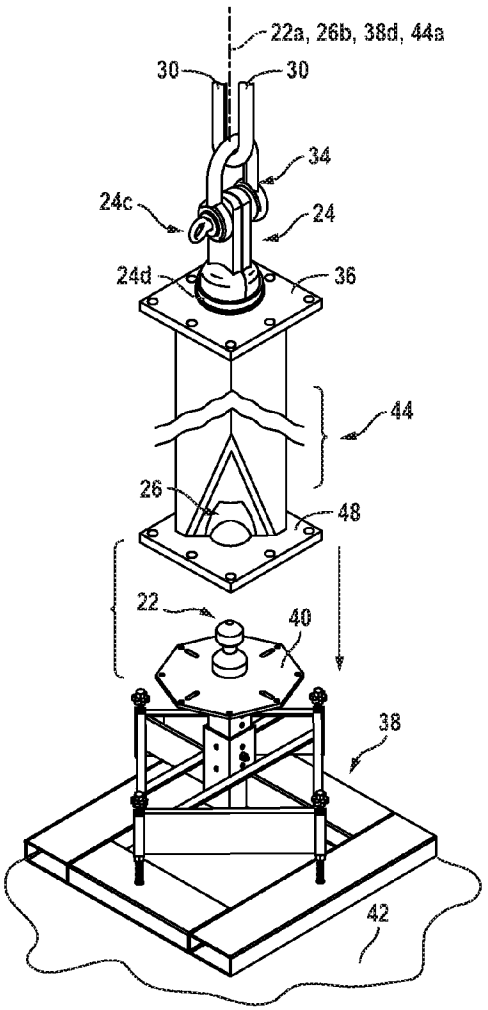

FIG. 9, which has an operational-display similarity to FIG. 7, illustrates, isometrically, both (a) clasp pick handling of what is seen here as an overhead column, and (b) stack-registry, cooperative camming employment of lug and guide-socket elements in the system of the present invention to achieve stack-registry, overhead-column/underlying column-base-support, vertical alignment in the process of an impending lowering of the illustrated column onto the top of the pictured column-base support structure. As in FIG. 7, a region broken away near the base of the overhead column shows impending, interactive camming engagement between the illustrated lug and guide socket.

Figure 10:
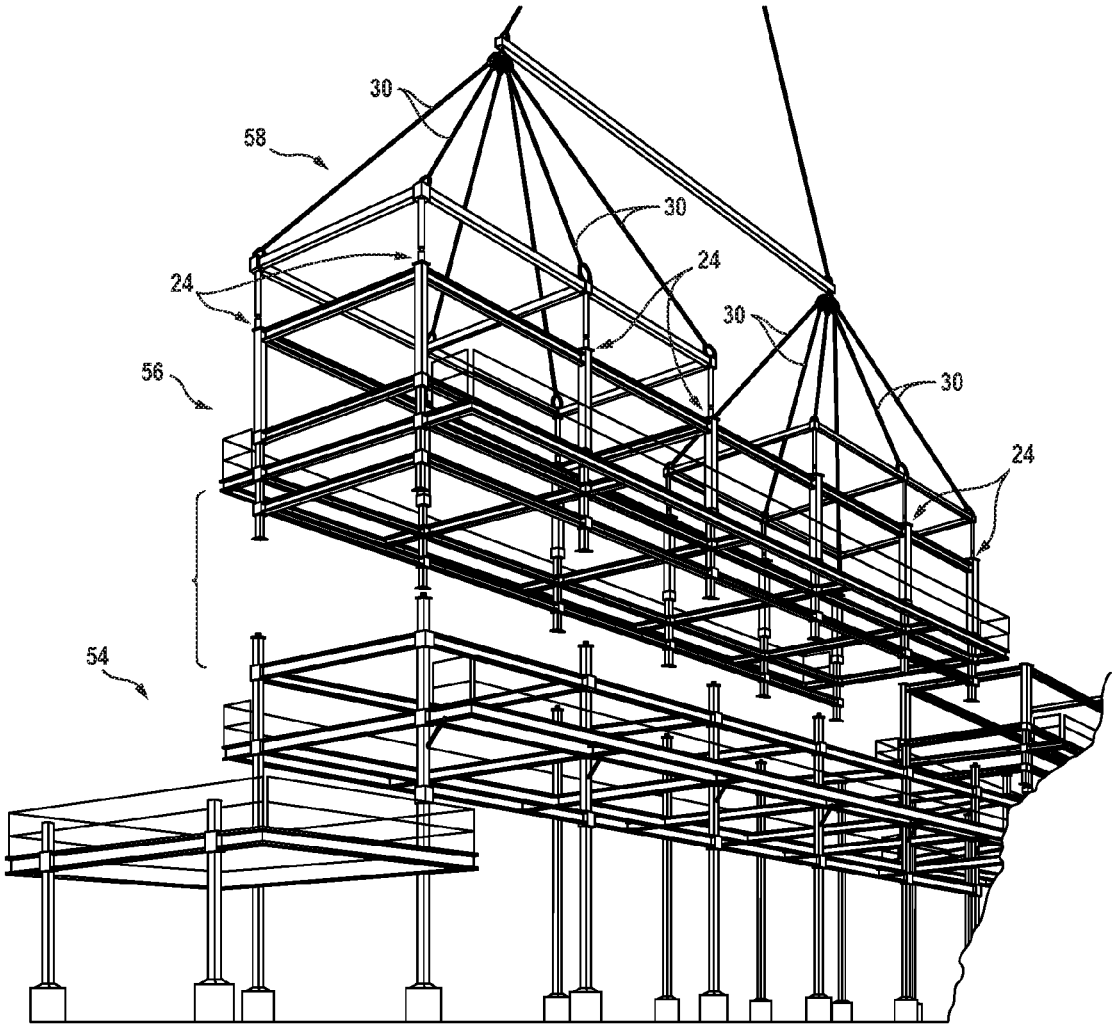

FIG. 10 illustrates, isometrically, frame-installation handling, in accordance with the present invention, of a preassembled building-frame module which is readied to be lowered onto, for mounting on, an under construction, underlying portion of a ground-supported, column and beam frame assembly.

The various structural elements, their proportions, and the positional relationships seen between them, presented in these drawing figures are not necessarily drawn to scale. Further, various structural components which are introduced in the discussion below, and which reference-numeraled in certain "earlier-discussed" drawing figures, where they appear as identical structures in the settings pictured in "other, later-described" drawing figures, will be identified herein with the same reference numerals.

DETAILED DESCRIPTION OF THE INVENTION

Turning now to the drawings, and referring, first of all to the "FIG. 1" collection of four views, here there is shown generally at 20 a system, constructed in accordance with preferred features of the present invention, for handling different, selected, structural building components that are typically employed in the fabrication of a structural building frame, or building-frame assembly—a task referred to herein as a building-frame construction project. In this construction-project setting, building components specifically illustrated and described herein in relation to the functioning of system 20 include columns, preliminarily-employed, column-base ground supports, and preassembled building-frame modules that possess interconnected columns and beams.

The specific character of the "FIG. 1" views is that, in addition to showing, in very simplified and schematic forms, each of the key structural elements of the system of the invention, they picture the two, different, principal, individual-building-component handling operations, or tasks, that are contemplated to be performed by the system structural elements—(1) building component "picking" for transporting and maneuvering a building component en route to placement in some intended location, and (2) "stack registering" of components in relation to effecting properly vertically aligned stacking of one building component on top of another such component for mounting there. Where stack registering is to occur, the system components are employed in what is referred to herein as a task-sequential manner, with the task of picking preceding the task of stack registering.

Later to be described FIG. 10 illustrates a "component" handling operation wherein a preassembled building-frame module is picked as a unit, maneuvered to a stack-registered condition over an already constructed portion of a ground-supported structural building-frame assembly, and lowered for mounting on that portion.

As was mentioned above in the descriptions of the various drawing figures, FIGS. 1A, 1B and 1C show what is referred to herein as a pick-handling operation, and FIG. 1D shows, in addition to the result of a previously initiated pick-handling operation, such as the pick-handling operation illustrated in FIGS. 1A, 1B and 1C, a related, following operation which is referred to herein as a sequentially implemented stack-registry component-handling operation.

These two operations are implemented by shortly-to-be-described, differentially cooperative interactions between the key system-20 structural elements, of which there are three in number. These include a dual-mode, sequential-task-operational, pick and stack-registry lug 22 which is attachable to a building component that is to be handled (such as a column, a column-base ground support, and a preassembled building-frame module, etc.), (2) a clamshell-style, releasable locking clasp 24, maneuverable, preferably, by any suitable maneuvering instrumentality, such as an attached cable, and adapted for cooperative, releasable gripping of the lug during a pick operation, and (3) a guide socket, or guide socket structure (also called herein a lug-reception guide socket, and a camming guide socket), 26 which functions as a lug guiding and aligning device for receiving the lug cooperatively under circumstances with one building component (such as a column) being lowered for mounting onto the top of another, underlying building component (such as another column or a column-base ground support) during a stack-registering, or stack-registry, operation.

In the pick-handling operation which is stage-illustrated in the collection of "FIG. 1" views, staged in the order of FIG. 1A, followed by FIG. 1B, and completed by FIG. 1C, a lug 22 is shown in FIGS. 1B and 1C anchored centrally to the top of an individual structural building component in the form of a column 28 (fragmentarily pictured), with the central, upright axes 22*a*, 28*a* of the lug and the column, respectively, aligned, and indicated by a shared, dash-dot line which is commonly marked with these two, axis-identifying reference numerals in FIG. 1B. Column 28, which is identified and pictured only schematically for illustration purposes in FIGS. 1B and 1C, is shown non-schematically, i.e., in realistic, but fragmentary, detail, in still-to-be-discussed, related FIG. 6.

Also shown in FIGS. 1A, 1B and 1C is a clasp 24, which includes two, relatively moveable clasp portions 24*a*, 24*b*, also referred to herein as ladle-shaped portions that are hinged at 24*c*. These clasp portions are shown in a clasp-open condition in FIGS. 1A and 1B, and in a clasp-closed condition in FIG. 1C. A clasp locking ring 24*d*, which is also included in the clasp, and which is slidably mounted on clasp portions 24*a*, 24*b*, is positioned relative to clasp portions 24*a*, 24*b* as seen in FIGS. 1A and 1B to permit the mentioned clasp-open condition for the clasp, and in FIG. 1C is positioned relative to, and specifically closely circumsurrounding, lower bowl regions (still to be discussed) in the two clasp portions to lock the clasp releasably, but securely, in its clasp-closed condition.

A support and maneuvering cable, shown fragmentarily at 30, which forms part of a conventional maneuverable cable suspension structure is appropriately connected to the clasp-portions hinge 24*c*. A suitable cable/hinge connection is illustrated in detail in, and is discussed shortly with respect to, what is shown in FIG. 3.

Considering now aspects of FIGS. 2 and 3 in relation to FIGS. 1A, 1B, 1C and 1D, details of an isolated lug 22 are shown in FIG. 2, and details of this isolated lug 22 and of clasp 24 are shown in FIG. 3.

Lug 22 includes a body of revolution 22*b* which defines a specially shaped, combined-utility, (a) grasp-and-capture, and (b) stack-registry camming, profile, also referred to herein as a longitudinal grasp- and capture profile, which is very evident in each of FIGS. 2 and 3. This profile features (1) a head 22*c* having one, maximum outside diameter $D_1$, (2) a longitudinally central, radially-inset, circumsurrounding, annular channel portion, or channel, 22*d* joined to and disposed below the head having a smaller (than $D_1$), longitudinally central, outside diameter $D_2$, and (3) a radially outwardly flared base 22*e* joined to and disposed below channel 22*d* having another, maximum outside diameter $D_3$ which is larger than diameter $D_2$ in the channel portion. Head 22*c* is formed with a rounded-top, upper, angular, conical camming surface 22*f* possessing a camming angle $\alpha$.

While different dimensions and camming angles, etc. may be selected for the features of lug 22, the lug disclosed herein has an overall height (its longitudinal dimension) of about 5.5-inches, diameters $D_1$, $D_2$ and $D_3$ herein, respectively, of about 3.9-inches, 2-inches and 5-inches, and a camming angle $\alpha$ of about 30-degrees.

Regarding clasp 24, in FIG. 3, the clasp is shown in solid lines in a clasp-open condition relative to, and poised to grasp, lug 22, and in dashed lines, in a clasp-closed condition securely grasping this lug in a releasably locked condition. Previously mentioned, ladle-shaped clasp portions 24*a*, 24*b* are elongate and identical. Referring just to clasp portion 24*a* as being structurally representative of both clasp portions, each clasp portion includes an elongate shank 24*e* joined at its lower end (in FIG. 3) to, and unified with, a bowl 24*f* which is formed with an outside, essentially semicircular surface of revolution (not specifically marked), and an inside, surface-of-revolution hollow, such as hollow 24*g*. Each shank also includes, adjacent its upper end, a throughbore 24*h* which forms part of previously mentioned hinge 24*c*. Hollows 24*g*, with the two clasp portions brought together to the clasp-closed condition, form a generally complementarily conforming receiving chamber for the head and channel portions in a lug 22.

Locking ring 24*d* is an appropriately sized annular structure which, as has already been mentioned, is slidably mounted on the two clasp portions. This locking ring possesses an inner, circular surface having a diameter which will allow the ring to slide, with appropriate, but close, clearance, downwardly over the outer surfaces in the clasp portions' bowls in order, selectively, to lock clasp 24 in a clasp-closed, releasably locked condition.

In the system now being described, hinge 24*c*, illustrated partly in dashed lines, is formed with a hinge pin 32 which extends freely through throughbores 24*h* in clasp portions 24*a*, 24*b*, and through the arms 34*a* in a conventional clevis 34 which, during use of a clasp 24, is suitably attached, as illustrated representationally in FIG. 3, to the outer end (not shown) of a support and maneuvering cable, such as previously mentioned cable 30. This hinge connection for clasp portions 24*a*, 24*b* permits free relative-motion swinging of the clasp portions toward and away from one another between their clasp-open and clasp-closed conditions. Other constructions for a suitable hinge connection are, of course, possible.

The pick-handling operation shown in FIGS. 1A, 1B and 1C illustrates use of lug 22 in its so-called pick operating mode in cooperation with clasp 24 in preparation for the maneuvering and handling of a picked building component, such as previously mentioned column 28. Clasp 24 is adjusted to have its clasp-open condition, as seen in FIG. 1A, and is maneuvered appropriately to become poised-associated with lug 22, as pictured in FIG. 1B. Clasp portions 24*a*, 24*b* are then closed upon the head and central channel portions of lug 22, and locking ring in 24*d* is lowered to create the releasably locked condition shown for the clasp in FIG. 1C (see also what is shown in dashed lines in FIG. 3 for the closed and releasably locked condition of clasp 24), thus to capture and grasp the lug within the substantially complementarily form-fitting receiving chamber formed in the bowls in clasp portions 24*a*, 24*b*.

Appropriate, safe and secure, completion of pick handling, transporting and maneuvering of column 28 in whatever fashion is desired during a frame-building project may now take place.

Turning attention at this point to what is shown in related FIG. 6, and thereafter to what is shown in FIG. 5 with respect to a similar pick-handling operation, in FIG. 6, which is largely self-explanatory, and mainly augmentive to what has just been described in relation to FIGS. 1A-3, inclusive, column 28 is shown (as was mentioned earlier herein) in a non-schematic, realistic, but fragmentary, fashion, here with a square (representative only), nut-and-bolt-accommodating, throughbore(36*a*)-including mounting plate 36 welded centrally to its top 28*b*. On top of plate 36 a lug 22 is centrally welded with its central, longitudinal axis 22*a*, coincident with the longitudinal central axis 28*a* of column 28. FIG. 6 essentially shows non-schematically what appears specifically in FIG. 1B.

Not seen in FIG. 6, but present in association, representatively, with all of the columns illustrated and discussed herein, are square, column-base-welded mounting plates that are similar to plate 36 in perimetral outline, as well as in the inclusion of the same pattern of nut-and-bolt-accommodating throughbores like throughbores 36*a*.

The similar pick-handling operation which is illustrated in FIG. 5 involves the pick handling of another type of an individual, structural building component which here takes one representative form of a preliminarily-used (during early frame assembly) column-base ground support 38, having a baseplate 38*a*, a central, column-support pedestal structure

38*b* which is mounted on baseplate 38*a* through verticality-modifying, screw-adjustable devices, such as the two such devices shown at 38*c*, and a central, upright axis 38*d*. An octagonal mounting plate 40, which plays a mounting role similar to that of above-described plate 36, is included centrally at the top of pedestal structure 38*b*. A lug 22 is centrally welded to plate 40 with its central, longitudinal axis 22*a*, coincident with the longitudinal central axis 38*d* of ground support 38. The specifically illustrated construction of ground support 38 does not form any part of the present invention.

Ground support 38, as illustrated in FIG. 5, is intended to rest herein, during its preliminary-use phase of building-frame-construction involvement, at an appropriate position directly on the ground, such as on the ground shown at 42 in FIG. 5.

Clasp 24 in FIG. 5 is, as described above respecting the first-discussed pick-handling operation, is adjusted to have its clasp-open condition, and is maneuvered appropriately to become poised-associated over lug 22 on plate 40. The clasp is lowered, clasp portions 24*a*, 24*b* are thereafter closed upon the head and central channel portions of lug 22, and locking ring in 24*d* is then lowered to create a closed and locked condition in clasp 24, thus to capture and grasp the lug in preparation for handling of support 38 for maneuvering and proper "ground-placement".

In the combined, completed pick handling and sequentially implemented stack-registry-handling operations shown in FIG. 1D, two, independent lugs 22 are seen anchored to the tops of two, different, individual, fragmentarily illustrated columns 44 (an overhead column, or component), and 46 (an underlying column, or component). These two lugs are specifically anchored with their respective central axes 22*a* aligned with the central axes 44*a*, 46*a* of their respective, associated columns 44, 46. A guide socket 26, having a body of revolution 26*a* with a central, upright axis 26*b*, is appropriately secured centrally within the base of column 44 (as will shortly be explained and more fully illustrated), and is disposed with its central axis 26*b* aligned with column axis 44*a*. In the relative dispositions of the structures which are shown in FIG. 1D, these structures are arranged with axes 22*a*, 26*b*, 44*a*, and 46*a* all aligned.

Revisiting something pointed out earlier herein, a matter which is relevant to what is pictured in FIG. 1D, a lug 22, in accordance with the invention, is specially configured to be functional, or operational, in relation to two different tasks or behavioral modes involving structural building-component handling. One of these modes is referred to as a pick mode. The other is referred to as a stack-registry mode, and also as a camming stack-registry mode—a mode which occurs in a following-sequential manner respecting a pick mode. The pick mode of building-component handling refers to the operation of grasping securely some structural building component, and then moving and maneuvering it to place it in some desired location and/or orientation. The stack-registry mode involves, essentially, following in sequence an almost completed pick mode, and maneuvering the building component picked in that pick mode to become an overhead component relative to another, underlying component, for stack-registered and properly vertically aligned lowering of the overhead component for mounting on top of the lower, underlying component. The important, cooperative system-element interaction which occurs in the stack-registry operating mode of the system of the invention, and of a lug constructed in accordance with the invention, in relation to overhead/underlying building components that are to be brought together in a properly vertically stacked and aligned condition, involves a camming, component-seating collaboration between a system guide socket which is furnished axially centrally in the underside of the overhead component, and a system lug which is anchored axially centrally to the top of the underlying component.

This is what is pictured as an impending event in the operation presented in FIG. 1D. In FIG. 1D, proper camming stack registering and vertical component (column-to-column) alignment will occur with lowering of column 44 and its included camming guide socket 26 onto the upper camming surface 22*f* in underlying lug 22 to seat properly vertically for mounting onto the top of column 46.

Considering now FIGS. 7 and 8 along with related FIG. 1D, FIG. 7 essentially shows the same operational situation pictured in FIG. 1D, i.e., an impending vertical stack registry between two columns, and FIG. 8 focuses on a completed condition of that operation, with the two columns involved, namely, columns 44, 46 aligned, and stack registered with column 44 properly disposed on top of column 46. As can be seen in FIGS. 7 and 8, welded centrally to the base 44*b*, also referred to herein as the component base, of column 44, as generally mentioned earlier, is a square mounting plate which is similar to previously mentioned mounting plate 36. Such a plate is indicated at 48 in FIGS. 7 and 8 at column base 44*b*. Plate 48 includes a central, circular opening 48*a* having a suitable diameter to provide clearance for stack-registry passage of a lug 22 during stacking of overhead and underlying building components, such as the stacking of two columns like columns 44, 46, and to expose the hollow inside of a centrally installed guide socket in the overhead component, such as the installed socket 26 seen in the inside base of overhead column 44 in FIGS. 7 and 8. Socket 26 has the previously mentioned body-of-revolution 26*a*, which includes, as is pictured in FIG. 8, a truncated, conical sidewall 26*c*, and a flat top 26*d*.

Digressing for just a moment, it should be mentioned that columns which are employed in the fabrication of building-frame assemblies may take on different forms depending upon specific applications. Herein, all of the representative columns which are illustrated and described are hollow in nature, have square cross-sections, and are of a type whose hollow interior has been filled appropriately with concrete. The description which now follows, discussing a guide socket 26, and specifically illustrating one manner of including such a socket within the base of a column, is presented specifically with respect to such a concrete-filled column interior.

Looking at FIG. 8, socket 26 is designed to be cammingly-receptive to engagement with, and to accommodating free, inside reception of, the body of a lug 22. In the base of a column, such as within the base of column 44 pictured in this figure, a guide socket 26 sits firmly within a concrete column filling material indicated at 50 that exists within column 44. The socket interior is fully exposed to the opening, such as opening 48*a*, in the plate, such as plate 48, which is below it.

While the specific column-base installation of a socket 26 is pictured and described herein in the context of the socket being firmly embedded in a concrete fill, in another type of column, similar in construction, but lacking a concrete fill, the structure of a socket may simply be suitably anchored inside the hollow, interior, base portion of such a base column. In yet another approach which may be used in certain instances for the creation of a guide socket functional in accordance with the invention, an appropriate guide socket could be formed directly in concrete-base-column-fill, per se.

In terms of the important, cooperative, stack-registry behavior of a lug 22 and a guide socket 26, when an overhead building component, such as column 44, is lowered for axially-aligned mounting on top of an underlying component, such as column 46, any initial, slight misalignment between these two components becomes adjusted through camming interaction which takes place effectively between the underside of the relevant guide socket structure and the upper, conical camming surface 22*f* in the lug. In the operation presented in FIG. 7, on lowering of column 44, cammingly-guided, stack-registry alignment of column 44 and column 46 takes place with proper axial alignment occurring for axes 22*a*, 26*b*, 44*a*, and 46*a*.

Directing attention now to FIG. 9, here illustrated is an underway, stack-registry operation which is very similar to the operation just described in relation to FIGS. 7, 8 and 1D, except that here, overhead column 44 is shown poised, for lowering, above a column base support 38. In the operation thus illustrated in FIG. 9, cammingly-guided, stack-registry alignment of column 44 and column base support 38, with proper axial alignment occurring for axes 22*a*, 26*b*, 38*d*, and 44*a*, is as described for the similar plural-axis-alignment action discussed with reference to what is shown in FIGS. 7 and 8.

Turning attention briefly to FIG. 4 in the drawings, illustrated generally, and fragmentarily, at 52, is a column-and-beam building frame assembly, including plural columns, all numbered 28, two column base supports, each numbered 38, and exposed lugs, all numbered 22. This assembly has been fabricated, at least in part, through the pick- and stack-registry behaviors just described respecting interactive performances of the lug, the clasp, and the guide socket structure of the system of the present invention.

Addressing attention now, finally, to FIG. 10, here illustrated is what is referred to herein as a combined building-frame-construction project, and an associated structural-component handling system which is functionally involved in the project, shown in operative conditions with respect to one another, relative to a particular fabrication stage in the construction project. In particular FIG. 10 pictures a building-component handling operation involving the lowering, for mounting onto a portion of an underlying, ground-supported, building-frame assembly 54, of an overhead, preassembled building-frame module 56.

As can be seen, and as those skilled in the art will recognize, frame-assembly portion 54 includes what may fairly be described as a defined pattern of elongate, upright columns with tops and upright axes. Similarly, and as can also be seen and appreciated by those skilled in the art, building-frame module 56 may also fairly be described as including a similarly-termed pattern of columns. In particular, module 56 herein has been preassembled in such a fashion that its included pattern of columns exactly matches an underlying, defined pattern of columns present in frame-assembly portion 54.

Supporting module 56 in a condition describable as being registry-poised, or registry-posed, above frame-assembly portion 54, through an appropriate plurality of locked clasps 24 that are in conditions securely grasping lugs (hidden in FIG. 10) which are anchored to the tops of the module columns, is an appropriate, conventional, maneuverable cable suspension and spreader-bar structure 58, typically overhead-crane managed (crane not shown), which connects appropriately to clasps 24.

Lowering of module 56 through appropriate operation of suspension and spreader-bar structure 58 with the two, above-described patterns of columns relatively closely aligned vertically, results, because of stack-registry interactions which take place between the lugs on the tops of the columns in the ground-supported frame assembly, and the guide sockets present in the bases of the columns in the frame module, in precision, camming-guided, column-to-column, stack-registry seating of the module-56 columns onto the tops of the assembly-54 columns to achieve the desired condition of gravity-seated stack registry between assembly 54 and module 56.

System 20 thus offers a special contribution to the art of structural building-component handling. The unique, and pivotally-important, dual-mode, sequential-task-operational, pick and stack-registry lug, especially, although not exclusively, in relation to its cooperative association with the system guide socket, centrally anchors and defines this contribution. This lug, with its advanced, body-of-revolution configuration, featuring a specially shaped, combined-utility, (a) grasp-and-capture, and (b) stack-registry camming, profile, designed thereby, in an "operational-alliance-switching" manner, to collaborate, in its pick operational mode, with the system clasp, and thereafter sequentially, where a building-frame fabrication project dictates, in its camming stack-registry mode, with the system guide socket, uniquely, and seamlessly, unites as a special, plural-purpose, component-handling team, the three principal elements of the system of the invention.

In conclusion, while a preferred embodiment of this system has thus been illustrated and described, and certain modifications suggested, we appreciate that other variations and modifications may be made without departing from the spirit of the invention, and it is our belief that all such variations and modifications will come within the scopes of the herein associated claims to invention.

We claim:

1. A method of frame construction, the method comprising:

placing a plurality of ground supports on the ground, each ground support including a base and a mounting plate connected to the base via a plurality of adjustment devices configured for adjusting height and orientation of the mounting plate relative to the base;

attaching a set of columns to the plurality of ground supports, each column of the set of columns being attached to the mounting plate of a respective ground support of the plurality of ground supports using bolts each extending through an end plate of the column and the mounting plate of the respective ground support; and interconnecting the set of columns using horizontal beams;

wherein each ground support includes a pedestal structure, wherein a lower portion of the pedestal structure is mounted to the base via the plurality of adjustment devices, and wherein an upper portion of the pedestal structure is supported by the lower portion and includes the mounting plate.

2. The method of claim 1, wherein the step of attaching includes a step of receiving lugs connected to the mounting plates in sockets defined through the end plates of the columns.

3. The method of claim 1, wherein the step of interconnecting creates a frame assembly of beams and columns, further comprising a step of uncoupling the frame assembly from the plurality of ground supports, and a step of lifting the frame assembly as a unit off the plurality of ground supports.

4. The method of claim 3, the set of columns being a first set of columns, further comprising a step of lowering the lifted frame assembly onto a second set of columns.

5. The method of claim 4, further comprising a step of attaching the frame assembly to the second set of columns after the step of lowering.

6. The method of claim 1, further comprising a step of manipulating one or more of the plurality of adjustment devices of one of the ground supports to adjust a height and/or orientation of the mounting plate of the one ground support relative to the base.

7. The method of claim 6, wherein the step of manipulating includes a step of manipulating four screw-adjustable devices of the one ground support.

8. The method of claim 1, wherein the step of interconnecting is performed with I-beams.

9. A frame system, comprising:

a plurality of ground supports, each ground support including a base and a mounting plate connected to the base via a plurality of adjustment devices configured for adjusting height and orientation of the mounting plate relative to the base; and a frame assembly supported by the plurality of ground supports and including a plurality of upright columns interconnected by a plurality of beams;

wherein each column of the plurality of upright columns has an end plate located at a bottom end of the column, and wherein a respective column of the plurality of upright columns is secured on each ground support using bolts each extending through the end plate of the respective column and the mounting plate of the ground support;

wherein each ground support includes a pedestal structure, wherein a lower portion of the pedestal structure is mounted to the base via the plurality of adjustment devices, and wherein an upper portion of the pedestal structure is supported by the lower portion and includes the mounting plate.

10. The frame system of claim 9, wherein each column has a socket defined through the end plate for mounting on a lug centrally positioned on a respective mounting plate.

11. The frame system of claim 9, wherein the end plate located at a bottom end of each column is a first end plate, and wherein each column of the plurality of upright columns has a second end plate located at a top end of the column, and wherein each of the first and second end plates defines a plurality of apertures.

12. The frame system of claim 11, wherein each of the first and second end plates defines a same pattern of apertures.

13. The frame system of claim 9, wherein the plurality of adjustment devices includes four screw-adjustable devices.

14. The frame system of claim 9, wherein the plurality of beams is a plurality of I-beams.

15. The frame system of claim 14, wherein the end plate of each respective column defines a plurality of apertures that are alignable with apertures of the mounting plate, to allow receipt of the bolts in the plurality of apertures aligned with the apertures of the mounting plate.

16. A column support system, comprising:

a ground support including (i) a base configured to rest on the ground and (ii) a mounting plate connected to the base via a plurality of adjustment devices configured for adjusting height and orientation of the mounting plate relative to the base, to enable the mounting plate to be aligned with a selected horizontal plane, the mounting plate defining a first set of apertures; and a column including an elongated body and an end plate, the end plate being welded to an end of the body and oriented orthogonal to a long axis defined by the body, the end plate defining a second set of apertures that are alignable with the first set of apertures;

wherein each of the adjustment devices defines a respective axis that passes through a plane of the mounting plate at a position outside the border of the mounting plate.

17. The column support system of claim 16, wherein the plurality of adjustment devices includes four screw adjustable devices.

* * * * *